US006775857B2

(12) United States Patent
Hughes, Jr. et al.

(10) Patent No.: US 6,775,857 B2
(45) Date of Patent: Aug. 17, 2004

(54) DRAIN FITTING DEVICE FOR SEALING AND FACILITATING INTRODUCTION OF FLUID OR GAS TO PRESSURIZE CLOGGED DRAIN

(76) Inventors: John M. Hughes, Jr., 7220 Manchester Ave., Kansas City, MO (US) 64133; Ronna A. Holloman-Hughes, 7220 Manchester Ave., Kansas City, MO (US) 64133

( * ) Notice: Subject to any disclaimer, the term of this patent is extended or adjusted under 35 U.S.C. 154(b) by 0 days.

(21) Appl. No.: 10/215,626

(22) Filed: Aug. 8, 2002

(65) Prior Publication Data

US 2004/0025236 A1 Feb. 12, 2004

(51) Int. Cl.[7] ..... E03D 9/00

(52) U.S. Cl. ..... 4/255.04; 4/255.01; 4/255.08; 124/168

(58) Field of Search ..... 4/255.01, 255.04, 4/255.06–255.09; 15/104.03, 104.05, 104.33; 134/167 C, 166 R, 168 C, 168 R, 169 C, 169 R

(56) References Cited

U.S. PATENT DOCUMENTS 994,442 A * 6/1911 Coles ..... 134/166 C
1,747,933 A * 2/1930 Goodman et al. ..... 138/94
2,197,716 A * 4/1940 Whitaker ..... 4/255.08
2,583,694 A * 1/1952 Fulton ..... 4/255.08
3,023,428 A * 3/1962 Otteson ..... 4/255.04
3,109,178 A * 11/1963 Bailey ..... 4/255.04
3,513,025 A * 5/1970 Gutrich ..... 134/24
3,874,926 A * 4/1975 Horne et al. ..... 134/24
3,937,404 A * 2/1976 Johnson ..... 4/255.09
4,238,860 A * 12/1980 Dixon ..... 4/255.08
4,542,543 A * 9/1985 Irwin ..... 4/255.02
4,606,364 A * 8/1986 Tash ..... 134/167 C
5,269,027 A * 12/1993 Iatropoulos ..... 4/255.08
5,524,296 A * 6/1996 Leighton ..... 4/255.05
5,992,697 A * 11/1999 James ..... 221/175
6,098,212 A * 8/2000 Rogan ..... 4/255.04
6,185,755 B1 * 2/2001 Shepherd et al. ..... 4/255.06
6,205,594 B1 * 3/2001 Solaberry ..... 4/255.04
6,618,873 B2 * 9/2003 Mulgrew et al. ..... 4/619

* cited by examiner

*Primary Examiner*—Henry Bennett
*Assistant Examiner*—Amanda Flynn
(74) *Attorney, Agent, or Firm*—Gerhard P. Shipley

(57) ABSTRACT

A drain fitting device (10) adapted to seal and facilitate introduction of a fluid, such as tap water, or a gas, such as compressed air, into a clogged drain (12), thereby pressurizing the drain (12) and removing the clog. In a preferred first embodiment, the device (10) broadly comprises a stopper element (14); a hose attachment mechanism (16); an expander mechanism (18); and a hose (20). The stopper element (14) fits within and substantially seals the drain (12). The expander mechanism (18) allows for compressing the stopper element (14), resulting in a circumferential expansion of the stopper element (14) to achieve a tighter seal with the drain (12). The hose (20) extends between and couples the device (10) with a source of pressurization (60) such that the fluid or the gas flows therefrom through the device (10) and into the clogged drain (12).

5 Claims, 2 Drawing Sheets

DRAIN FITTING DEVICE FOR SEALING AND FACILITATING INTRODUCTION OF FLUID OR GAS TO PRESSURIZE CLOGGED DRAIN

BACKGROUND OF THE INVENTION

1. Field of the Invention

The present invention relates to devices for removing clogs from drains. More particularly, the present invention concerns a drain fitting device adapted to seal and facilitate introduction of a fluid, such as tap water, or a gas, such as compressed air, into a clogged drain, thereby pressurizing the drain and removing the clog.

2. Description of the Prior Art

It is often necessary to remove a stubborn clog from a drain, and the prior art provides a number of mechanisms and techniques for doing so. It is known, for example, to use conventional liquid or powder clog-dissolving products to remove the clog, but these can be undesirably expensive or chemically caustic and may not remove or may require substantial time or multiple applications to remove particularly stubborn clogs. It is also known for do-it-yourselfers to dismantle the offending plumbing themselves to remove the clog. Many people, however, are unwilling or unable to do this for a number of reasons, including, for example, a lack of specialized tools and a fear that their efforts might create worse problems than the clogged drain. For these people, the assistance of a professional plumber can be exceedingly expensive and may require making an appointment for days in the future. It is also known to use a plunger to remove the clog, but this can require a substantial amount of practiced technique and physical effort, and, even then, is not always successful.

Often, removing the stubborn clog requires that physical force be applied to the material of which the clog is comprised, particularly when such material is wedged within the drain. It is known, for example, to insert an elongated wire snake or similarly suitable item into the drain until the wire snake contacts the clog, and then to push or spin an end of the wire snake against the clog in an attempt to break-up and remove the clog. Unfortunately, the wire snake suffers from a number of disadvantages, including, for example, that it must be of sufficient length to reach all potential clogs, thereby necessitating that the wire snake, even if coilable, be an undesirably large piece of equipment which can be difficult to store and to handle during use. Furthermore, the wire snake acts through physical insertion into the drain and physical contact with the clog, thereby risking damage to the drain or internal plumbing mechanisms. Additionally, once the clog is removed, the wire snake must be removed from the drain and cleaned, which process can be particularly distasteful and inconvenient, particularly where the clog was deep within the drain.

Due to the above-identified and other problems and disadvantages in the art, there exists a distinct need for an improved mechanism for removing clogs from drains.

SUMMARY OF THE INVENTION

The present invention solves the above-identified and other problems and disadvantages in the prior art to provide a drain fitting device adapted to seal and facilitate introduction of a fluid, such as tap water, or a gas, such as compressed air, into a clogged drain, thereby pressurizing the drain and removing the clog. In a preferred first embodiment, the device broadly comprises a stopper element; a hose attachment mechanism; an expander mechanism; and a hose.

The stopper element is adapted to fit within or otherwise physically relate to or associate with the drain so as to substantially seal the drain. A hole extends completely through the stopper element, from top to bottom. The stopper element may be constructed of a compressible material, such as, for example, rubber or a rubber composite, such that compression of the stopper element causes its circumference to expand so as to achieve a tighter seal with the drain. Alternatively, the stopper element may be constructed of a substantially non-compressible material, such as, for example, plastic or nylon, in which case its circumference may be provided with grooves for receiving one or more O-rings adapted to facilitate achieving a tighter seal with the drain.

The hose attachment mechanism is associated with a top portion of the stopper element and the hole that extends therethrough, and is adapted to facilitate coupling the hose to the stopper element. The hose attachment mechanism may, for example, take the form of a protrusion adapted to fit within the hose or to receive the hose.

The expander mechanism is adapted to facilitate expanding the stopper element, particularly where the stopper element is constructed of the compressible material. The expander mechanism includes a plate; a sleeve; and a nut. The plate is positioned over the stopper element and adapted to distribute a compressive force applied thereto. A hole is provided in the plate, which corresponds to and aligns with the hole in the stopper element. The sleeve is positioned in the hole in the stopper element and extends through the hole in the plate. The sleeve is hollow, providing a flowpath therethrough, and presents external threads. Furthermore, the protrusion of the hose attachment mechanism may be incorporated into an upper portion of the sleeve. The nut is adapted to threadably engage the external threads of the sleeve such that tightening the nut upon the sleeve and against the plate causes the compressive force which expands the circumference of the stopper element.

The hose is adapted to couple the device with a source of pressurization and to provide a flowpath therebetween for the fluid or compressed gas. Thus, as mentioned, the hose extends between and couples the protrusion of the hose attachment mechanism with the source of pressurization.

The source of pressurization may be any suitable source of fluid, such as a conventional faucet providing tap water, or gas, such as a conventional cylinder or pump providing compressed air, operable to provide a pressure of approximately between 5 $lbs/in^2$ and 30 $lbs/in^2$, which should be sufficient to remove the clog.

Thus, it will be appreciated that the device of the present invention provides a number of substantial advantages over the prior art devices and techniques, including, for example, that the performance of the device does not require that it be of sufficient size and length to physically reach the clog in the drain, and is therefore easier and more convenient to store and to handle during use. Furthermore, the device does not act through physical insertion into the drain and physical contact with the clog, and therefore reduces risks of damaging the drain or internal plumbing mechanisms. Additionally, because the device does not substantially enter the drain or contact the clog, the device does not require substantial or extraordinary cleaning efforts after use.

These and other important features of the present invention are more fully described in the section titled DETAILED DESCRIPTION OF A PREFERRED EMBODIMENT, below.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
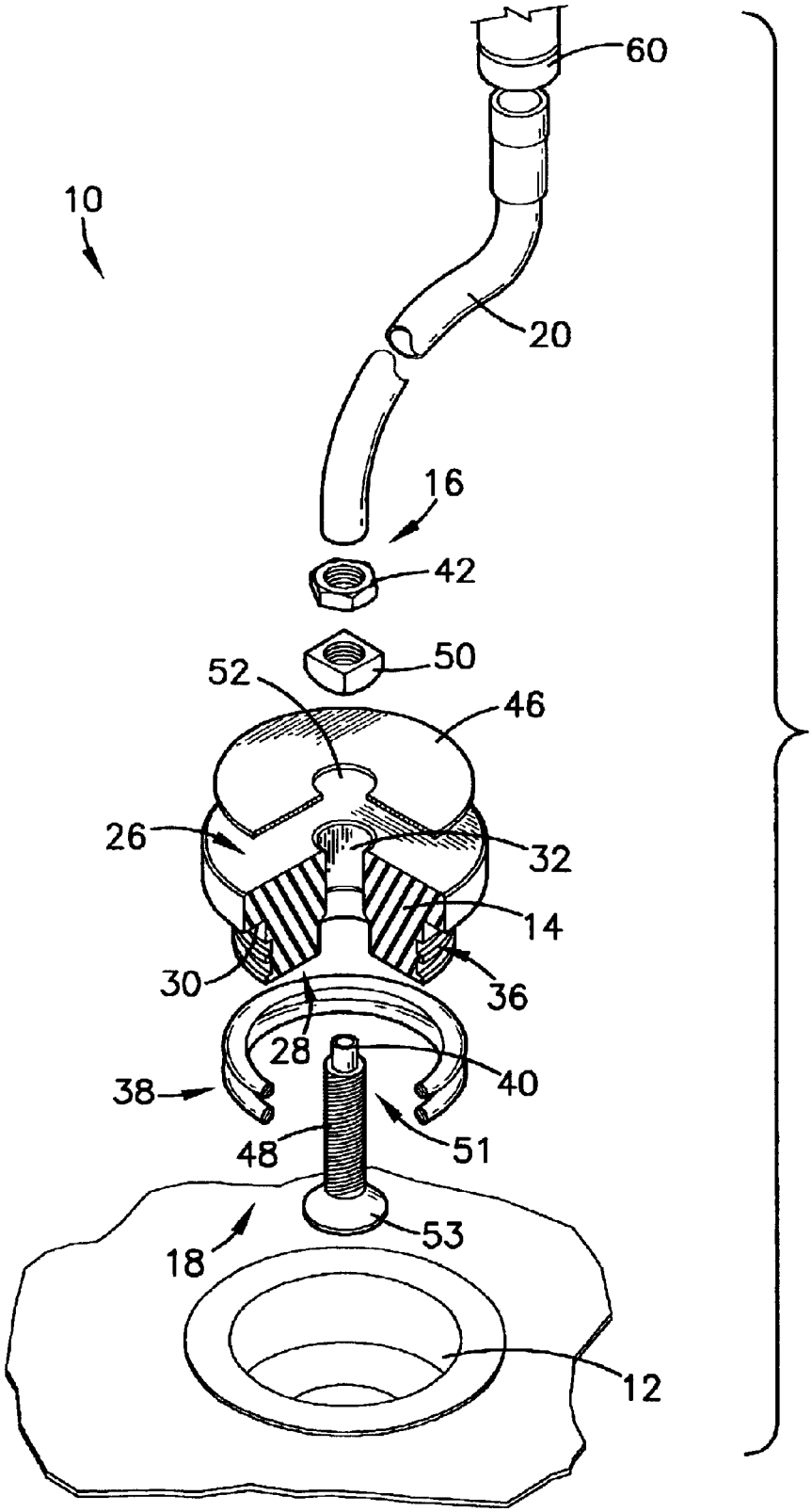
FIG. 1 is an exploded isometric view of a preferred first embodiment of the device of the present invention.

Referring to FIG. 1, a drain fitting device 10 is shown constructed in accordance with a preferred first embodiment of the present invention. The device 10 is adapted to seal and facilitate introduction of a fluid, such as tap water, or a gas, such as compressed air, into a clogged drain 12, thereby pressurizing the drain 12 and removing the clog. As illustrated, the preferred first embodiment broadly comprises a stopper element 14; a hose attachment mechanism 16; an expander mechanism 18; and a hose 20.

The stopper element 14 is adapted to fit within or otherwise physically relate to or associate with the drain 12 so as to substantially seal the drain 12. The stopper element 14 is substantially cylindrical, presenting a top portion 26 and a bottom portion 28. The top portion 26 may present a circumferential lip 30 which remains above the drain 12 and facilitates achieving a tighter seal therewith. The bottom portion 28 may present a slight taper so as fit better or farther within the drain 12 to further facilitate achieving a tighter seal therewith. A hole 32 extends completely through the stopper element 14, from the top 26 to the bottom 28. The stopper element 14 is substantially independent of any particular dimensions, being instead dimensionable to fit a variety of drains, from, for example, large kitchen sink drains to small bathroom sink drains.

The stopper element 14 may be constructed of a compressible material, such as, for example, rubber or a rubber composite, such that compression of the stopper element 14 causes its circumference to expand so as to facilitate achieving a tighter seal with the drain 12. In an alternative embodiment, the stopper element 14 may be constructed of a substantially non-compressible material, such as, for example, plastic or nylon, in which case its circumference may be provided with grooves 36 for receiving one or more O-rings 38 adapted to facilitate achieving a tighter seal with the drain 12.

The hose attachment mechanism 16 is associated with the top portion 26 of the stopper element 14 and the hole 32 that extends therethrough, and is adapted to facilitate coupling the hose 20 thereto. The hose attachment mechanism 16 may take the form of a protrusion 40 adapted to fit within the hose 20 or to receive the hose 20, and may also include a nut 42 for tightening upon or about the hose 20 in order to further seal the hose 20 to the hose attachment mechanism 16.

The expander mechanism 18 is adapted to facilitate expanding the stopper element 14, particularly where the stopper element 14 is constructed of the compressible material. It will be appreciated that a variety of suitable mechanisms are readily deviseable for causing or facilitating such expansion. As illustrated, however, the expander mechanism 18 includes a plate 46; a sleeve 48; and a nut 50. The plate 46 is positioned over the top portion 26 of the stopper element 14 and adapted to distribute a compressive force applied thereto. A hole 52 is provided in the plate 46, which corresponds to and aligns with the hole 32 in the stopper element 14.

The sleeve 48 is positioned in the hole 32 in the stopper element 14 and extending through the hole 52 in the plate 46. The sleeve 48 is hollow, providing a flowpath therethrough, and presents an externally-threaded upper portion 51. A bottom portion 53 of the sleeve 48 may be flared to prevent the sleeve 48 from being pulled through the hole 32 during tightening of the nut 50, and to enhance compression of the stopper element 14 against the plate 46.

The nut 50 is adapted to threadably engage the upper portion 51 of the sleeve 48 such that tightening the nut 50 upon the sleeve 48 and against the plate 46 causes the compressive force which expands the circumference of the stopper element 14.

The hose 20 is adapted to couple the device 10 with a source of pressurization 60 and to provide a flowpath therebetween for the fluid or compressed gas. As illustrated, the protrusion 40 connects the hose 20 with the device 10, wherein, as mentioned, the hose 20 can either fit within or around the protrusion 40, and the nut 42 can be used to tighten the hose 20 against the protrusion to facilitate achieving a tighter seal therebetween. The hose 20 can be constructed of any flexible tubing or hose of a suitable diameter.

The source of pressurization 60 may be any suitable source of fluid, such as tap water, or gas, such as compressed air, operable to provide a pressure of approximately between 5 $lbs/in^2$ and 30 $lbs/in^2$, which should be sufficient to remove most clogs. The source of pressurization 60 may be a conventional water faucet, in which case the hose 20 is adapted to extend between and couple the hose attachment mechanism 16 with the water faucet, such that water provided by the water faucet enters the sealed drain 12 via the hose 20, the hose attachment mechanism 16, and the stopper element 14, and pressurizes the clogged drain 12. Alternatively, the source of pressurization 60 may be a conventional source of compressed air, such as, for example, an air pump or an air cylinder, in which case the hose 20 is adapted to extend between and couple the hose attachment mechanism 16 with the source of compressed air, such that compressed air provided by the source of compressed air enters the sealed drain 12 via the hose 20, the hose attachment mechanism 16, and the stopper element 14, and pressurizes the clogged drain 12.

In exemplary use and operation of this preferred first embodiment, once a user detects that the drain 12 is clogged, the user first inserts the sleeve 48 into the hole 32 in the stopper element 14 such that the upper portion 51 of the sleeve 48 and the protrusion 40 project through and upwardly from the top portion 26. The user then pushes the stopper element 14 into the drain 12 as far as possible or until the circumferential lip 30 contacts the surface surrounding the opening of the drain 12. A substantial seal will exist at this point, due both to the stopper element 14 itself and to the O-rings 38 provided thereabout. The plate 46 is then placed on the top portion 26 of the stopper element 14 such that the upper portion 51 of the sleeve 48 and the protrusion 40 project through and upwardly from the hole 52 therein. The nut 50 of the expander mechanism 18 is then threaded onto the upper portion 51 of the sleeve 48 and tightened to compress the stopper element 14 between the plate 46 and the flared bottom portion 53 of the sleeve 48, thereby causing an expansion its circumference and achieving and even tighter seal with the drain 12. The hose 20 is then slipped over the protrusion 40, and the nut 42 of the hose attachment mechanism 16 is threaded onto the upper portion 51 of the sleeve 48 and tightened thereupon to achieve a tight seal between the hose 20 and the protrusion 40.

The free end of the hose 20 is then coupled with the source of pressurization 60, which, in this case, is a faucet fixture. Water flows from the faucet through the hose 20, through the sleeve 48 and into the clogged drain 12. When the water encounters the clog, pressure will begin to build. The device 10, used with a typical household faucet, should provided approximately 20 lbs/in$^2$ of pressure, which should be sufficient to remove even stubborn clogs.

Figure 2:
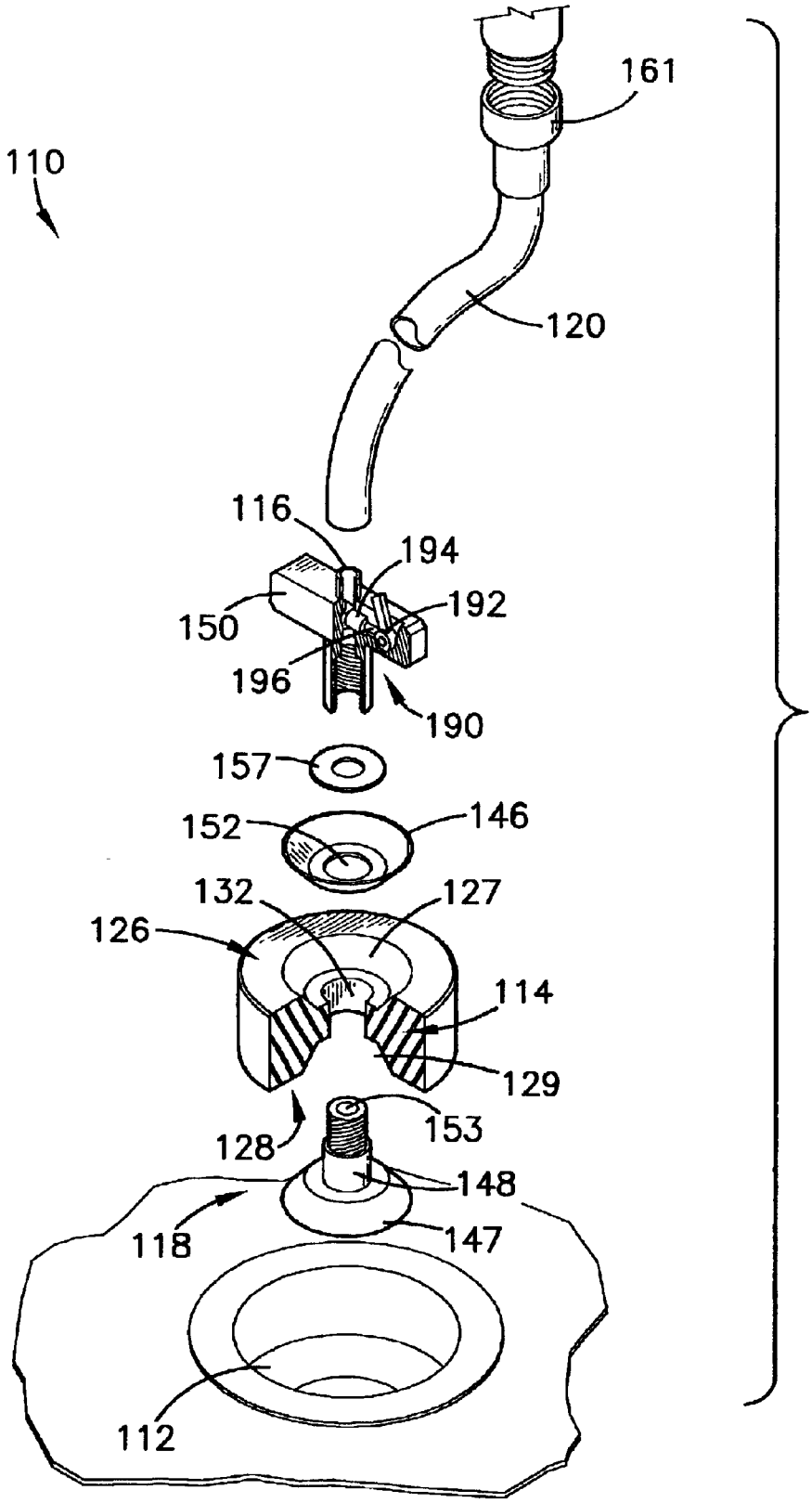
FIG. 2 is an exploded isometric view of a preferred second embodiment of the device of the present invention.

Referring to FIG. 2, a preferred second embodiment of the device 110 is shown, wherein the preferred second embodiment is substantially similar to the above-described preferred first embodiment but for the following differences. The device 110 broadly comprises the stopper element 114; the hose attachment mechanism 116; the expander mechanism 118; the hose 120; a threaded adaptor 161; and a control mechanism 190.

The stopper element 114 is adapted to fit within or otherwise physically relate to or associate with the drain 112 so as to substantially seal the drain 112. The stopper element 114 is substantially cylindrical, presenting a top portion 126 and a bottom portion 128. The top and bottom portions 126,128 both present tapered concavities 127,129. The hole 132 extends from one tapered concavity 127,129 to the other. The stopper element 114 is constructed of a compressible material, such as, for example, rubber or a rubber composite, such that compression of the stopper element 114 causes its circumference to expand so as to facilitate achieving a tighter seal with the drain 112.

The expander mechanism 118 is adaptable to facilitate expanding the stopper element 114. It will be appreciated that a variety of suitable mechanisms are readily deviseable for causing or facilitating such expansion. As illustrated, however, the expander mechanism 118 includes a top plate 146; a bottom plate 147; a sleeve 148; a T-bar handle 150; and a washer 157. The top and bottom plates 146,147 are positioned within the tapered concavities 127,129 of the top and bottom portions 126,128 of the stopper element 114, and are adapted to distribute a compressive force applied to them. A hole 152 is provided in the top plate 146, which corresponds to and aligns with the hole 132 in the stopper element 114. A hole 153 is also provided in the bottom plate 147. The sleeve 148 is secured, as, for example, by welding, to the bottom plate 147, and positioned in the hole 132 in the stopper element 114 to extend through the hole 152 in the top plate 146. The sleeve 148 is hollow, providing a flowpath therethrough which is aligned with the hole 153 in the bottom plate 147, and includes the externally-threaded upper portion.

The T-bar handle 150 operates as a nut element and is internally-threaded and otherwise adapted to threadably engage the upper portion of the sleeve 148 such that tightening the T-bar handle 150 upon the sleeve 148 draws the top and bottom plates 146,147 together and thereby causes the compressive force which expands the circumference of the stopper element 114. The T-bar handle 150 is hollow and aligns with the flowpath through the sleeve 148. The hose attachment mechanism 116 is located at the top of the T-bar handle 150 and is aligned with the flowpath through the T-bar handle 150 and the sleeve 148. The washer 157 is interposed between the T-bar handle 150 and the top plate 146 to facilitate distributing the compressive force.

The threaded adaptor 161 provides a substantially secure mechanism for removably coupling the hose 120 with the source of pressurization.

The control mechanism 190 provides the user with an ability to control the flow of fluid or gas from the source of pressurization into the drain 112. It will be appreciated that this feature is particularly advantageous where the source of pressurization, and any primary controls associated therewith, is located some distance from the device 110. The control mechanism 190 may take any suitable form, but is illustrated as being incorporated into the T-bar handle 150 and including a lever 192; a valve element 194; and a connector rod 196. The lever 192 is movable; the valve element 194 is movably positioned within the flowpath extending through the T-bar handle 150; and the connector rod 196 couples the lever 192 with the valve element 194 to transmit control movements therebetween. Thus, movement of the lever 192 actuates the connector rod 196 which, in turn actuates the valve element 194 to correspondingly increase or decrease the flow of the fluid or gas through the flowpath and into the drain 112.

In exemplary use and operation of this preferred second embodiment, once a user detects that the drain 112 is clogged, the user first inserts the sleeve 148 into the hole 132 in the stopper element 114 such that the bottom plate 147 is seated within the concavity 129 in the bottom portion 128 of the stopper element 114 and the sleeve 148 projects through and upwardly from the top portion 126. The user then positions the stopper element 114 in the drain 112. A substantial seal will exist at this point, due to the nature of the material of the stopper element 114. The top plate 146 is then placed and seated within the concavity 127 of the top portion 126 of the stopper element 114 such that the sleeve 148 projects through and upwardly from the hole 152 therein. The T-bar Handle 150 of the expander mechanism 118 is then threaded onto the externally threaded sleeve 148 and tightened to draw the top and bottom plates 146,147 together and thereby compress the stopper element 114. This results in an expansion of the stopper element's circumference, thereby achieving an even tighter seal with the drain. The hose 120 is then slipped over the hose attachment mechanism 116.

The other end of the hose 120 is then threadably coupled with the source of pressurization, which, in this case, is a cylinder of compressed air, using the threaded adaptor 161. The source is then made to release air into the hose 120. No air will flow into the drain 112, however, until the control mechanism 190 is actuated. Movement of the lever 192 causes corresponding movement of the valve element 194 and causes the air to begin flowing into the drain 112. When the air encounters the clog, pressure will begin to build. The device 110, used with a typically air cylinder or pump, should provided approximately between 5 lbs/in$^2$ and 30 lbs/in$^2$ of pressure, wherein the pressure is controllable using the control mechanism 190, which should be sufficient to remove even stubborn clogs.

From the preceding description, it will be appreciated that the device 10 of the present invention provides a number of substantial advantages over the prior art, including, for example, that the performance of the device 10 does not require that it be of sufficient size and length to reach the clog in the drain, and is therefore easier and more convenient to store and to handle during use. Furthermore, the device 10 does not act through physical insertion into the drain and physical contact with the clog, and therefore reduces risks of damaging the drain or internal plumbing mechanisms. Additionally, because the device 10 does not substantially enter the drains or contact the clog, the device 10 does not require substantial or extraordinary cleaning efforts after use.

Although the invention has been described with reference to the two preferred embodiments illustrated in the attached drawings, it is noted that equivalents may be employed and substitutions made herein without departing from the scope of the invention as recited in the claims. For example, specific features shown associated with a particular one of the preferred embodiments can be readily adapted for use with the other preferred embodiment.

Having thus described the preferred embodiment of the invention, what is claimed as new and desired to be protected by Letters Patent includes the following:

1. A device for substantially sealing and facilitating pressurization of a clogged drain, the device comprising:

a stopper element having a top and a bottom and being adapted to fit within and substantially seal the clogged drain, there being a hole in the stopper element which extends between the top and the bottom, wherein the stopper element is constructed of a compressible material such that compression of the stopper element causes a circumference of the stopper element to expand so as to facilitate achieving a tighter seal with the clogged drain;

a hose attachment mechanism aligned with the hole in the stopper element;

a hose coupleable with the hose attachment mechanism and with a source of pressurization, such that the source of pressurization is operable via a flowpath provided by the hose, the hose attachment mechanism, and the stopper element to pressurize the drain;

an expander mechanism including a plate position on the top of the stopper element and adapted to distribute compressive force applied thereto, there being a hole in the plate which corresponds to the hole in the stopper element, a sleeve position in the hole in the stopper element and extending through the hole in the plate, with the sleeve being hollow and presenting an externally-threaded upper portion, and wherein the hose attachment mechanism protrudes from the sleeve, and a nut element adapted to threadably engage the upper portion of the sleeve such that tightening the nut element upon the sleeve and against the plate causes the compressive force which expands the circumference of the stopper element.

2. A device for substantially sealing and facilitating pressurization of a clogged drain, the device comprising:

a stopper element having a top and a bottom and being adapted to fit within and substantially seal the clogged drain, there being a hole in the stopper element which extends between the top and the bottom, wherein the stopper element is constructed of a compressible material such that compression of the stopper element causes a circumference of the stopper element to expand so as to facilitate achieving a tighter seal with the clogged drain;

a hose attachment mechanism aligned with the hole in the stopper element and adapted to facilitate coupling a hose with the device, wherein the hole in the stopper element and the hose attachment mechanism cooperate to provide a flowpath into the clogged drain; and an expander mechanism adapted to facilitate expanding the circumference of the stopper element, the expander mechanism including a plate positioned on the top of the stopper element and adapted to distribute a compressive force applied thereto, there being a hole in the plate which corresponds to the hole in the stopper element;

a sleeve positioned in the hole in the stopper element and extending through the hole in the plate, with the sleeve being hollow and presenting an externally-threaded upper portion, and wherein the hose attachment mechanism protrudes from the sleeve, and a nut element adapted to threadably engage the upper portion of the sleeve such that tightening the nut element upon the sleeve and against the plate causes the compressive force which expands the circumference of the stopper element.

3. A device for substantially sealing and facilitating pressurization of a clogged drain, the device comprising:

a stopper element having a top and a bottom and being adapted to fit within and substantially seal the clogged drain, there being a hole in the stopper element which extends between the top and the bottom, wherein the stopper element is constructed of a compressible material such that compression of the stopper element causes a circumference of the stopper element to expand so as to facilitate achieving a tighter seal with the drain opening;

an expander mechanism adapted to facilitate compressing the stopper element, the expander mechanism including a plate positioned on the top of the stopper element and adapted to distribute a compressive force applied thereto, there being a hole in the plate which corresponds to the hole in the stopper element;

a sleeve positioned in the hole in the stopper element and extending through the hole in the plate, with the sleeve being hollow and presenting an externally-threaded upper portion, and a nut element adapted to threadably engage the upper portion of the sleeve such that tightening the nut element upon the sleeve and against the plate causes the compressive force which expands the circumference of the stopper element; and a hose attachment mechanism aligned with the sleeve and adapted to facilitate coupling a hose with the device, wherein the hose attachment mechanism and the sleeve cooperate to provide a flowpath through the device and into the clogged drain.

4. The device as set forth in claim 3, wherein the stopper element includes one or more circumferential O-rings adapted to facilitate achieving a tighter seal with the clogged drain.

5. The device as set forth in claim 3, wherein the nut element is an internally-threaded handle.

* * * * *